United States Patent [19]

Bindernagel et al.

[11] 4,391,357

[45] Jul. 5, 1983

[54] COUPLINGS

[75] Inventors: Ali Bindernagel, Wermelskirchen; Helmut Holthoff, Düsseldorf; Hartmut Diel, Monchen-Gladbach, all of Fed. Rep. of Germany

[73] Assignee: Friedrich Kocks GmbH & Company, Hilden, Fed. Rep. of Germany

[21] Appl. No.: 114,114

[22] Filed: Jan. 21, 1980

[30] Foreign Application Priority Data

Feb. 14, 1979 [DE] Fed. Rep. of Germany ..... 2905560

[51] Int. Cl.[3] ..... F16D 19/00

[52] U.S. Cl. ..... 192/94; 403/343; 403/16; 464/44; 74/424.8 R

[58] Field of Search ..... 64/6, 28 R, 30 C, 30 R; 403/16, 343; 192/36, 35, 96, 97, 94; 74/424.8 R

[56] References Cited

U.S. PATENT DOCUMENTS

| | | | |
|---|---|---|---|
| 468,682 | 2/1892 | McLaughlin | 192/94 |
| 2,364,019 | 11/1944 | Beall | 192/54 |
| 2,893,524 | 7/1959 | Ferrier | 192/94 |
| 3,240,513 | 3/1966 | Turzillo | 403/343 |
| 4,274,620 | 6/1981 | Uher | 192/94 |

*Primary Examiner*—Charles J. Myhre
*Assistant Examiner*—Carl Stuart Miller
*Attorney, Agent, or Firm*—Buell, Blenko, Ziesenheim & Beck

[57] ABSTRACT

A coupling is provided in which a coupling member and coupling sleeve of a rotary coupling for coupling a drive transmission to a rolling mill stand input shaft have mating taper threads which provide torsional rigidity and facilitate quick engagement and release. Engagement and release are effected by slowly turning the coupling half by means of the drive transmission while a brake device engages dogs on the coupling half to prevent the latter rotating. The coupling sleeve is flexibly attached to the flange by sheet metal laminate compensating elements but mobility of the sleeve is restricted by a support element on a shaft extension.

22 Claims, 5 Drawing Figures

COUPLINGS

This invention relates to couplings and particularly to an engageable and disengageable coupling for interconnecting two machine shafts so as to be non-rotatable relative to one another, e.g. for coupling output shafts of a rolling mill drive to drive shafts of rolling stands.

A large variety of couplings for interconnecting two shafts is known, including engageable and disengageable couplings which permit short-term separation or reconnection of the two shaft ends. A special type of engageable and disengageable couplings is a so-called quick release coupling in which the coupling operation is effected without manual intervention and in which idle times are largely avoided.

The shafts to be interconnected are in many cases not accurately aligned with one another and their central longitudinal axes slope relative to one another, even if the angle of slope is only small, and/or they are offset laterally or vertically parallel to one another. The reason for this can reside in manufacturing tolerances, inaccuracies of assembly, heating phenomena and the like. In the case of rolling mill drives, the adjusting movement of the rolls frequently causes such parallel off-set of the shafts to be coupled.

Thus, it is known to provide at least one compensating element for compensating for angular offset and/or misalignment of the shafts. However, two compensating elements are required in most couplings of this type, since, in addition to angular offset, misalignment generally has to be compensated for, thus requiring a second compensating element.

In a known coupling of this type having two compensating elements, internal and external teeth, acting as torque-transmitting coupling means, mesh with one another and are interengaged in an axial direction. In order to achieve this, one coupling half has a telescopic withdrawing device comprising a multi-splined shaft and a complementary sleeve.

The known engageable and disengageable couplings of the type mentioned above have the substantial disadvantage that they are not free from play in the direction of rotation when they are in the coupled state. The reason for this is that the torque-transmitting coupling means and the telescopic withdrawing devices comprise teeth which must necessarily have play in order to function properly, since they would otherwise not be engageable or axially displaceable. The play required renders them unsuitable for middle and higher rotational speeds, since considerable vibration is caused in the teeth by this play and leads to the destruction of associated bearings, gear wheels and other machine elements. Such vibrations can also cause marks on the work material during the driving of rolling stands. Thus, many drives require play-free couplings, particularly for connecting output shafts of a rolling mill drive to the drive shafts of rolling stands. This particularly applies to rolling stands whose rolls rotate at high speeds, such as is the case, for example, in wire rolling mills.

Although play-free couplings are known (including, for example, all rigid disc couplings), these types of couplings cannot be engaged or disengaged without considerable expenditure of labor. This loss of time and expenditure of labor is uneconomical and scarcely acceptable, particularly when a large number of such couplings has to be engaged or disengaged. Thus, for example, the down times of a rolling mill are prolonged to a considerable extent by inadequate couplings if rolling stands have to be interchanged due to wear on the rolls or due to a change of the rolling program and the couplings of the drive then also have to be released and recoupled.

An object of the invention is to provide a coupling which is entirely free from play with respect to the transmission of torque and which is mechanically engageable and releasable without manual intervention and without visual access on the part of the operator.

Accordingly, the invention provides an engageable and releasable rotary coupling for the nonrelatively rotatable interconnection of two rotary machine parts, the coupling comprising two coupling halves of which one includes a screw-threaded member having an external taper thread which is screwable into a complementary internal taper thread in a sleeve of the other coupling half to act as a coupling means for transmitting torque from one machine part to the other, the screw-threaded member and the screw-threaded sleeve being axially movable towards and away from one another, enabling a drive for one of the two machine parts and a brake for the other machine part to be used in conjunction for engaging and releasing the coupling.

An absolutely torsionally rigid connection is obtained by the screwing-together of the taper threads and it is possible to dispense with teeth of all kinds which always interengage with play. This torsionally rigid interconnection of the two coupling halves renders it possible to use the coupling even at very high rotational speeds without the occurrence of vibration which can adversely affect bearings, gear wheels and other associated parts. When couplings of this type are used to connect output shafts of a rolling mill drive transmission to the drive shafts of the associated rolling stands, such as wire-rolling stands whose rolls rotate at a very high speed, there is no undue risk of marks appearing on the work material and, nevertheless, it is possible to interchange the stands rapidly by rapidly releasing the couplings.

The use of a taper-threaded member and a complementary screw-threaded sleeve has the further advantage, that, when the two coupling halves are pushed together in an axial direction, automatic centering is effected and is particularly important when one or a plurality of compensating elements are used to compensate for angular offset and/or misalignment of the shafts. It is even usual to use at least one, generally even two, compensating elements of this kind, since, in many cases of application, it is not ensured that angular offset and misalignment of the shafts will not occur. In all these cases, as a result of the compensating elements (which can be absolutely torsionally rigid), and the flexibility thereof, the two coupling halves are located opposite one another with a slight amount of radial offset when the coupling is released. Automatic centering is effected upon engaging the coupling in accordance with the invention, thus ensuring engagement of the coupling in an operationally reliable manner.

Taper-threaded members which are screwed into a complementary screw-threaded sleeve are known in screw connections, although connections of this kind have not hitherto been used in engageable and releasable couplings for the connection of two machine shafts. Screw connections of this kind were considered to be unserviceable for the coupling of two machine shafts, and numerous other constructions have been proposed which, however, were not satisfactory for the reasons mentioned initially.

In order to engage the coupling in accordance with the invention, the two coupling halves have to be pushed together in an axial direction, it being possible to effect this in various ways. In the first instance, as in the known constructions, it is possible to provide a telescopic withdrawing device, although this device would have the disadvantage that the connection would no longer be torsionally rigid owing to the unavoidable play in the telescopic withdrawing device. Therefore, in a preferred embodiment of the invention, the axial movement of the coupling means is effected by displacing at least one of the machine shafts or the associated machine unit, such as the rolling mill stand. The telescopic withdrawing device can then be dispensed with, and the connection remains torsionally rigid. Namely, in a large number of cases, at least one machine shaft or one of the associated machine units can be readily displaced in an axial direction by the slight amount required for engaging and disengaging the coupling in accordance with the invention. If this coupling is used in rolling mill drives, a device for displacing the rolling stands is frequently already provided in order to facilitate interchange of the rolling stands. Alternatively, on the other hand, it is possible economically to construct the drive transmissions so as to be displaceable.

It is particularly advantageous if the screwthreaded member and the screw-threaded sleeve are movable one into the other before the commencement of the rotary movement for the purpose of the coupling operation, one of the same being connected to its shaft so as to be non-rotatable relative thereto and being displaceable to a limited extent in an axial direction relative to its shaft against the force of a spring, and the other, or counter-member, abuts against an alignment stop, whereupon the displaceable screw-threaded member or the screw-threaded sleeve is screwable into or onto the respective counter-member upon commencement of the rotary movement. The advantage of this embodiment resides particularly in the fact that, even without a telescopic withdrawing device, one is not forced to displace the axially displaceable machine shaft or the displaceable machine unit accurately in synchronism with the screw-thread to be coupled, which means that these parts do not have to be displaced exactly at that speed which results from the pitch of the screw-thread and the screw-in or screw-out speed. This would require considerable additional expenditure. Instead of this, in the construction in accordance with the invention, the coupling means are pushed one into the other when the shafts are stationary, although they automatically center themselves in a radial direction owing to their conical configuration. The rotary movement which finally screws the coupling means together commences only when the coupling means have been pushed to a sufficient extent one into the other and have been coaxially aligned by the stop. There is no longer any need to displace any of the machine shafts or machine units in an axial direction, since the displaced screw-threaded member or the displaced screw-threaded sleeve returns to its initial position. Owing to the taper of the screw-thread, the screw-threaded member and the screw-threaded sleeve then clamp together, thus leading to a torsionally rigid connection. It can then be advantageous to provide the screw-threaded member or the screw-threaded sleeve with engaging splines and slots which extend in a substantially axial direction, in order to render play-free clamping to an appropriate element of the respective coupling half.

As already mentioned above, one of the two shafts is braked by the brake device upon engaging the coupling in accordance with the invention, while the shaft at the drive side rotates at a low speed and interconnects the coupling means by a screwing action. It is thereby advantageous if the brake device releases the braked shaft when a predetermined, preferably adjustable initial torque of the coupling means is reached. In accordance with a preferred feature of the invention, this can be effected in that, upon coupling, the brake device offers to a stop surface of the braked shaft a stop which yields at a predetermined torque. In a further development of the invention, this yielding stop can be a piston or a piston rod of a cylinder which is subjected to the pressure of a pressure medium only up to the attainment of the predetermined torque of the braked shaft. The yielding of the stop can then be regulated in dependence upon pressure or travel. Mechanical solutions are also conceivable. In this manner, it is ensured that the coupling means are always interconnected in a reliable and adequately rigid manner and there is no risk of unintentional disengagement.

On the other hand, it is advisable for the brake device to offer a fixed stop to the stop surface of the braked shaft upon uncoupling. It is only this fixed stop that ensures reliable release of the coupling even when, during operation, the screw-threaded member and the screw-threaded sleeve have been screwed into one another more rigidly than intended.

When coupling a plurality of adjacently disposed shafts to shafts arranged opposite thereto in a corresponding manner, particularly in cases where a common drive is provided, special conditions prevail if it is desired simultaneously to couple the respective couplings to one another. In such a case, it is advisable to arrange the stops of all the couplings on an axially displaceable beam and selectively to bring into operation either the stops for the coupling operation or the stops for the uncoupling operation. By way of example, the beam can be arranged on a drive mechanism housing or, alternatively, on the coupling side of the working machines to be driven.

In a rolling mill drive for a plurality of rolling stands arranged in tandem and having a rolling mill drive mechanism having a corresponding number of output shafts arranged in tandem, further special conditions prevail, since the rotational speed of the individual shafts differ during operation and, in the case of a group drive, the coupling means are also screwed together at different speeds during the coupling operation. The coupling in accordance with the invention also proves to be successful in such a case, since it is pushable together in the first instance without a rotary movement, so that the differing rotational speeds cannot have a disadvantageous effect. When the coupling means are screwed together after having been pushed together, this is effected at different low speeds at the individual shafts owing to the differing rotational speeds, although with the same initial torque owing to the yielding stop. Consequently, the coupling in accordance with the invention is particularly suitable for coupling the shafts of rolling mill distribution drive transmissions to the drive shafts of rolling stands. Since the coupling in accordance with the invention is self-centering, is engageable and disengageable with the rolling mill drive and this operation is effected automatically without visual supervision being necessary for this purpose, the couplings can be actuated without difficulty from a remote-control desk.

The invention is further described, by way of example, with reference to the drawings, in which.

Figure 1:
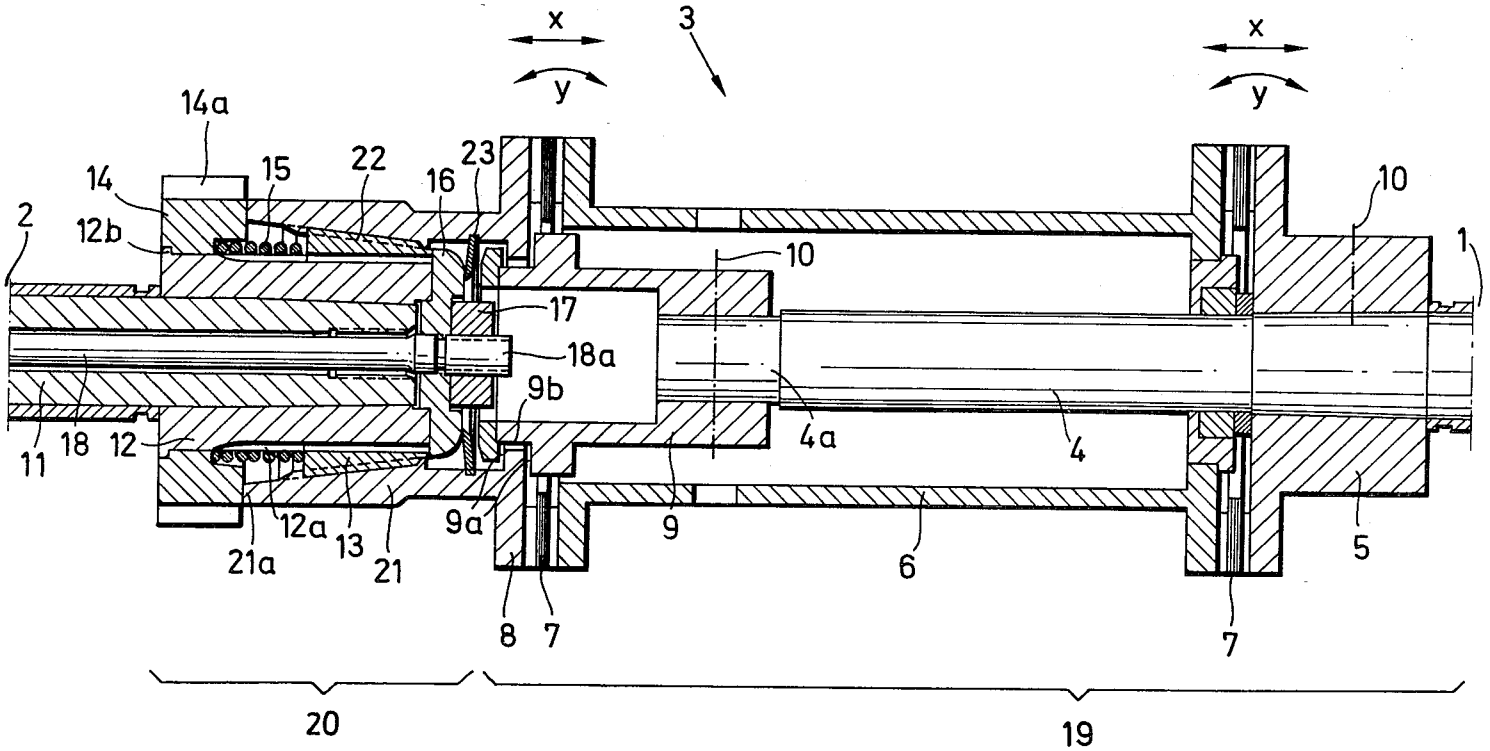
FIG. 1 is a longitudinal section through one embodiment of coupling according to the invention.

Referring to FIG. 1, a working machine 2 is driven from a drive transmission 1, the torque being transmitted by a torsionally rigid coupling 3.

The drive transmission 1 has a transmission shaft 4 on which a flange 5 of the coupling 3 is fitted so as to be non-rotatable relative thereto. The torque is transmitted from the flange 5 to a coupling sleeve 6 by way of a compensating element 7 comprising a large number of sheet metal laminations which are alternately bolted in the region of their circumferences to the flange 5 and to the coupling sleeve 6. A compensating element of this kind enables the coupling sleeve 6 to move axially and to tilt relative to the flange 5 in the direction of the arrows X and Y, but without any angular backlash in the direction of rotation of the drive or in the opposite direction thereto. The opposite end portion of the coupling sleeve 6 has a further compensating element 7 by which the coupling sleeve 6 is connected to a further flange 8, in the same manner as it is connected to the flange 5, so as to be movable in the direction of the arrows X and Y, although it is connected thereto in a torsionally rigid manner.

In order to limit the movement of the coupling sleeve 5 and of the flange 8, the transmission shaft 4 is of particularly long construction and extends far into the coupling sleeve 6. A support member 9 is fitted on an end stud 4*a* of the shaft 4 and side surfaces 9*a* of a groove in the support member limit the axial movement of the flange 8 and thus also of the coupling sleeve 6, and the bottom surface 9*b* of the same groove limits the radial movement of the flange 8 and thus also of the coupling sleeve 6. The flang 5 and the support member 9 are rigidly secured to the transmission shaft 4 by bolts or pins 10 which are indicated only by dash-dot center lines.

A coupling bush 12 is mounted on the drive shaft 11 of the working machine 2 so as to be non-rotatable relative thereto and a portion of its length is provided with splines 12*a*. A screw-threaded member 13 having a complementary bore profile is slipped onto the coupling bush 12. An external taper thread 22 on the member 13 mates with a complementary internal taper thread in a screw-threaded sleeve 21 integral with the flange 8. A compression spring 15, which urges the screw-threaded member 13 to the right as viewed in FIG. 1, is disposed between the screw-threaded member 13 and a stop flange 14 which abuts against a collar 12*b* of the coupling bush 12. The screw-threaded member 13 is secured by a disc 16 which is in turn held by means of a nut 17 which is screwed onto a screw-threaded end 18*a* of a pull rod 18 in the interior of the drive shaft 11.

Thus, the two coupling halves, which are designated 19 and 20, essentially comprise, on the one hand, the flange 5, the two compensating elements 7, the coupling sleeve 6 and the flange 8 with its integral screw-threaded sleeve 21 and, on the other hand, the coupling bush 12, the screw-threaded member 13, the stop flange 14, the compression spring 15, the plate 16 and its nuts 17 and the pull rod 18.

If the coupling of FIG. 1 is to be uncoupled, the stop flange 14 and the coupling bush 12 rigidly connected thereto and the screw-threaded member 13 are retained in a manner described hereinafter, while the coupling half 19 is slowly rotated by the normal drive motor (not illustrated in FIG. 1) by way of the drive transmission 1, so that the taper thread 22 is unscrewed and the screw-threaded member 13 is in the first instance displaced to the left (as viewed in FIG. 1) against the action of the compression spring 15. Owing to the frusto conical construction of the thread 22, the screw-threaded member 13 and the screw-threaded sleeve 21 are rapidly disengaged from one another, so that the coupling halves 19 and 20 can be drawn apart in an axial direction. This is effected by displacing either the drive transmission 1 or the working machine 2 to the right or the left respectively by the amount required for this purpose. It is also conceivable to move the drive mechanism and the working machine apart. A resilient sealing ring 23 fitted in the screw-threaded sleeve 21 prevents dirt and foreign bodies from entering the screw-threaded sleeve 21, particularly between the coupling bush 12 and the screw-threaded member 13 and between the threads of the screw-threaded sleeve 21 itself. Owing to their dead weight, the flange 8 and its screw-threaded sleeve 21 will assume a position in which they slope downwardly through a limited angle in the direction of the arrow Y as soon as the coupling halves 19 and 20 have been separated.

If it is desired to interconnect the two coupling halves 19 and 20 again, either the drive transmission 1 or the working machine 2 is shifted or, if required, both these parts are shifted towards one another, the downwardly sloping position of the screw-threaded sleeve 21 being eliminated by the centering action of the taper thread 22 which then enters the interior of the screw-threaded sleeve 21, although this is in the first instance effected only to the extent that the leading edge of the screw-threaded member 13 strikes against the thread of the screw-threaded sleeve 21 in the central longitudinal portion. However, the coupling halves 19 and 20 are then pushed together to a further extent, so that the screw-threaded member 13 is pushed back to the left against the action of the compression spring 15. The pushing together of the coupling halves 19 and 20 is effected until the end face 21*a* of the screw-threaded sleeve 21 strikes against the stop flange 14 and is thus aligned coaxially, and it is no later than this that the screw-threaded sleeve 21 is located in a coaxial position and no longer in a position sloping relative to the longitudinal axis of the coupling. After the pushing-together of the coupling halves 19 and 20 has thus been completed, the stop flange 14 together with the coupling bush 12 and the screw-threaded member 13 are fixedly held, while the drive transmission 1 is used to slowly rotate the screw-threaded half 19 and thus also the screw-threaded sleeve 21, whereby the screw-threaded member 13 and the screw-threaded sleeve 21 are screwed together and the compression of the compression spring 15 is simultaneously relieved. Axial slots (not illustrated) in the screw-threaded member 13 enable the latter to be resiliently compressed in a circumferential direction. The radial contact pressure which occurs upon the screwing-together of the taper thread 22 thus reduces the internal diameter of the screw-threaded member 13 to an extent that the slight clearance between the screw-threaded member 13 and the coupling bush 12 in the region of the multiple splines 12*a* is fully taken up. A torsionally rigid, readily releasable connection is obtained in this manner.

Figure 2:
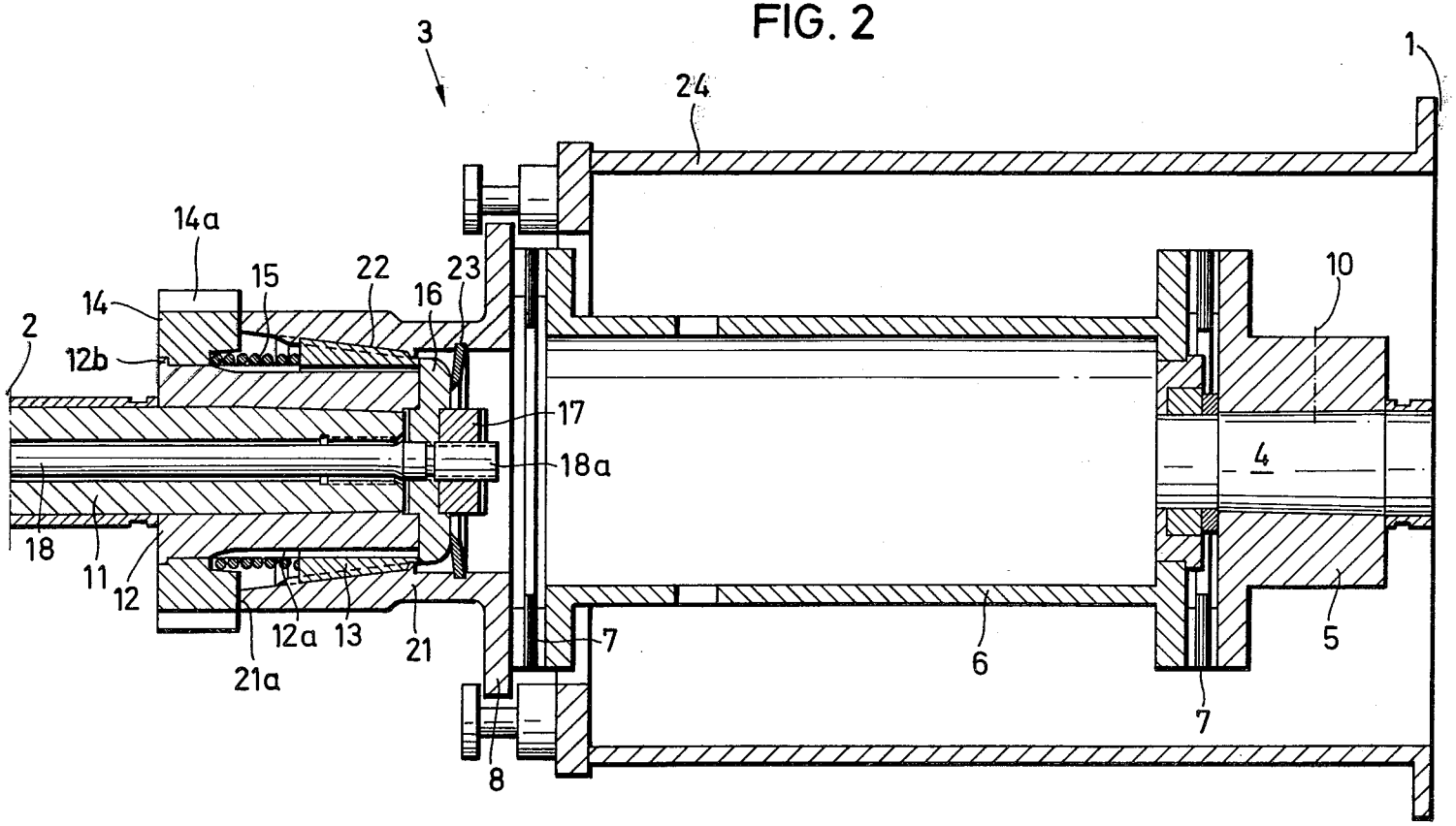
FIG. 2 is a longitudinal section through a second embodiment of the coupling.

The embodiment shown in FIG. 2 corresponds substantially to the embodiment shown in FIG. 1, and for this reason, the same reference numerals have been used for comparable parts. The difference only resides in the fact that the sloping position of the coupling sleeve 6 and of the screw-threaded sleeve 21 is not limited by a support member 9 in the interior of the coupling 3, but by a holder 24 which surrounds the coupling 3 externally and which is secured to the housing of the drive transmission 1. The support member 9 and the extension of the transmission shaft 4 are thus omitted, so that a drive mechanism having a normal output stub can be used.

Figure 3:
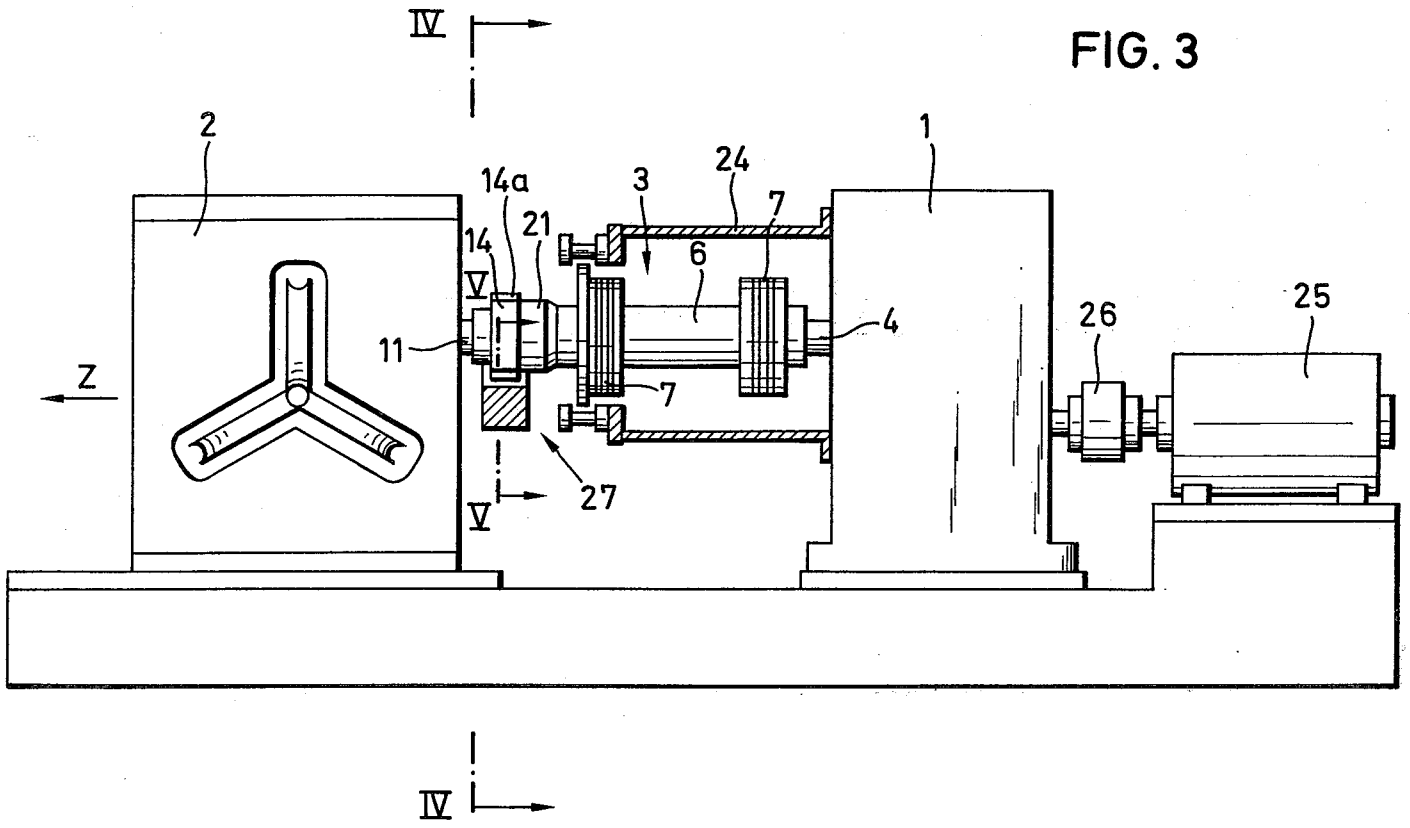
FIG. 3 is a side elevation of a rolling mill drive equipped with the coupling in accordance with the invention.

FIG. 3 shows how the coupling 3 in accordance with the invention is fitted in a rolling mill drive. A rolling stand is the working machine 2 which is driven by a drive motor 25 by way of a coupling 26 and the drive transmission 1. If, for example, the rolling stands 2 (a large number of which are arranged in tandem, although this is not shown in FIG. 3) are to be changed, the couplings 3 have to be released in the first instance. For this purpose, the stop flange 14 has to be fixedly held, this being effected by means of a brake device 27. It is only thereafter that the rolling stand 2 can be removed in the direction of the arrow Z.

Figure 4:
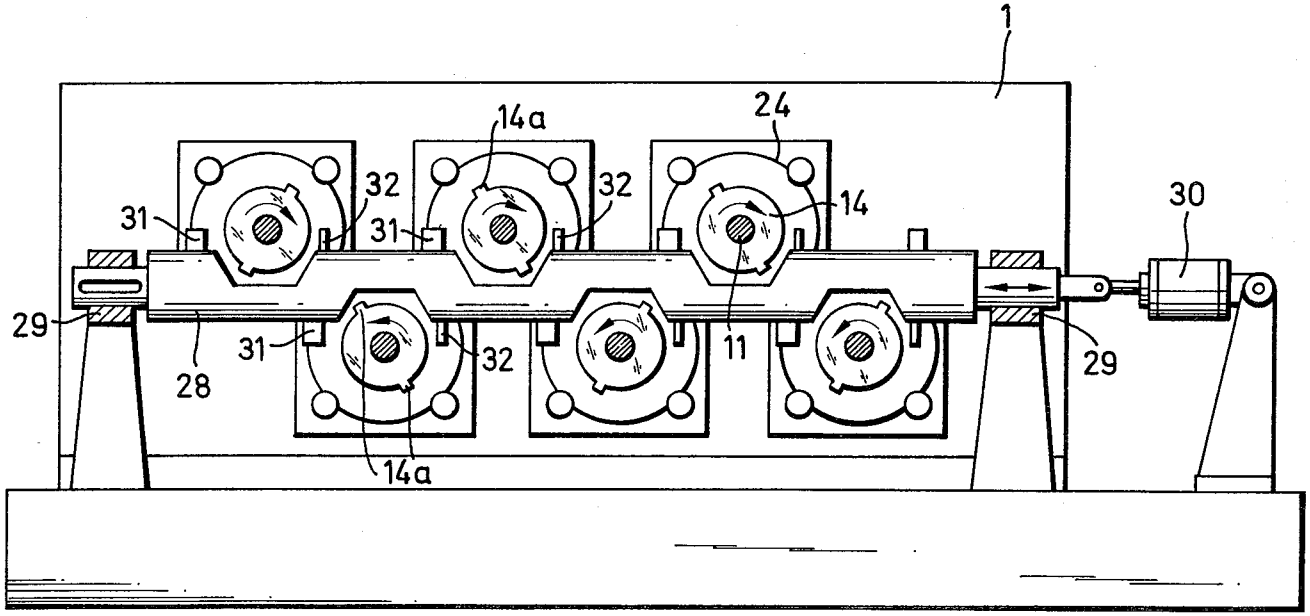
FIG. 4 is a cross section taken on the line IV-13 IV of FIG. 3.

The brake device 27 is shown in FIG. 4. It includes a beam 28 which is held by bearings 29 so as to be non-rotatable but axially displaceable. The beam 28 is displaced by the required amount by means of a pressure medium cylinder 30. The beam 28 is shown in its central position which it assumes during normal operation. The arrows shown in FIG. 4 indicate the normal direction of rotation during operation corresponding to the requirements of the rolling stands. It may clearly be seen that the stop flanges 14 have doglike projections 14*a* and that the beam 28 has stops 31 and 32 which are arranged in pairs in the region of each coupling 3.

If the couplings 3 are to be released, pressure medium is admitted to the working cylinder 30 such that the working cylinder 30 moves the beam 28 to the right as viewed in FIG. 4, so that the stops 31 enter the region of the stop dogs 14*a*. The stop dogs 14*a* strike against the fixed stops 31 and retain the stop flanges 14 when the drive transmission 1 is driven at a low speed in the opposite direction to its normal working direction for the purpose of releasing the couplings 3. Consequently, the stop flanges 14 are held in the required manner, so that the taper thread 22 and thus the couplings 3 are released. This operation lasts for a different period of time at different rotational speeds, and for this reason one has to wait until all the couplings 3 have been released. The taper threads 22 of those couplings 3 which are the first to be released do not suffer any damage, since they are rapidly disengaged owing to their frusto conical construction, and the compression springs 15 are not sufficiently strong to cause damage to the taper threads 22. The rolling stands 2 can then be changed.

The coupling operation is effected with the pushing of the rolling stands 2 into their working positions, the beam 28 then being displaced to the left as viewed in FIG. 4. The stops 32 then enter the region of the stop dogs 14*a*, so that the stop flanges 14 are held when the drive transmission 1 is driving in its normal direction of rotation, the drive being regulated to a low rotational speed in the first instance. As described above, this leads to torsionally rigid coupling of the couplings 3, the taper threads 22 being tightened with predetermined, optionally adjustable torques. When the torques have been attained, the stops 32 yield and thus release the stop flange 14. As soon as this is the case with all the couplings 3, the beam 28 is moved to its central position (as shown in FIG. 4) and the drive motor 25 is regulated to the operating speed required.

Figure 5:
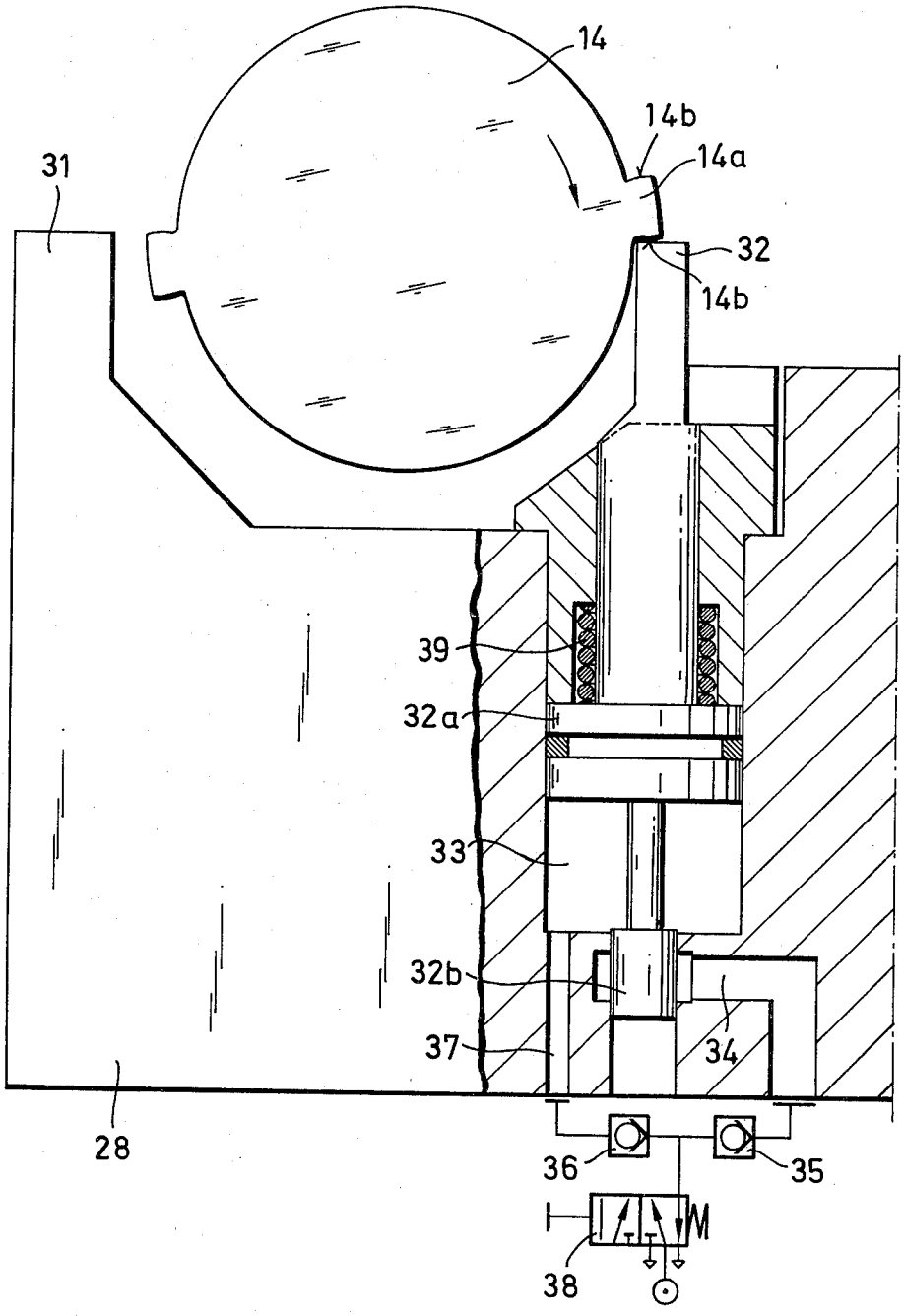
FIG. 5 is a cross section taken on the line V—V of FIG. 3.

FIG. 5 showns that all the stops 31 are rigid in order to ensure that the coupling 3 is released. Furthermore, FIG. 5 shows how the yielding of the stop 32 can be achieved. As soon as the stop surface 14*b* of the stop dog 14*a* loads the stop 32, the latter compresses preferably air in a cylindrical chamber 33, that end portion of the stop 32 which is remote from the stop flange 14 being in the form of a piston 32*a*. A control spool 32*b* is integrally formed with the stop 32 and its piston 32*a* and, together with the stop 32, moves downwardly upon the compression of the air in the cylindrical chamber 33. The pressure in the cylindrical chamber 33 and thus the torque which is effective on the stop flange 14 are thereby increased. When the maximum pressure and thus the desired torque have been obtained, the upper edge of the control spool 32*b* opens an outlet passage 34, so that the cylindrical chamber 33, and thus the stop 32, are abruptly relieved via a non-return valve 35. A spring 39 urges the piston 32*a*, and thus the stop 32, into the bottom end position. The stop dogs 14*a* can then rotate freely after the coupling 3 has been screwed together with the desired torque.

Pressure medium can be admitted to the cylindrical chamber 33 again by way of a non-return valve 36 and an inlet passage 37 when a slide valve 38 is displaced to the right, so that the stop 32 is returned to its illustrated starting position again. The pressure in the cylindrical chamber 33, and thus the value of the effective torque, can be adjusted by means of a valve (not shown) which regulates the air flowing into the cylindrical chamber 33.

In the foregoing specification, we have set out certain preferred practices and embodiments of our invention; however, it will be understood that this invention may be otherwise embodied within the scope of the following claims.

We claim:

1. An engageable and releasable rotary coupling for the non-relatively rotatable interconnection of two rotary machine parts the coupling comprising two coupling halves, one said coupling half including a screw-threaded member having an external taper thread, the other of said coupling half including a sleeve having a complementary internal taper thread screwably receiving the external taper thread of said one half to act as a coupling means for transmitting torque from one machine part to the other, the screw-threaded member and the screw-threaded sleeve being axially movable towards and away from one another, means associated with one of said machine parts axially moving one of said coupling halves generally axially relatively to the other thereby enabling a drive for one of the two machine parts and a brake device for the other machine part to be used in conjunction for engaging and releasing and coupling, said coupling having means by which the screw-threaded member and the screw-threaded sleeve can be pushed axially one into the other before the commencement of the rotary movement for the purpose of the coupling operation, one of said member and sleeve being connected to its rotary machine part so as to be non-rotatable relative thereto and being displaceable to a limited extent in an axial direction relative to its rotary machine part against the force of a spring, and the other abutting against an alignment stop on its connected rotary machine part, whereupon the displaceable screw-threaded member or the screw-threaded sleeve is screwably engaged with the respective countermember upon commencement of the rotary movement.

2. An engageable and releasable rotary coupling for the non-relatively rotatable interconnection of two rotary machine parts the coupling comprising two coupling halves, one said coupling half including a screw-threaded member having an external taper thread, the other of said coupling half including a sleeve having a complementary internal taper thread screwably receiving the external taper thread of said one half to act as a coupling means for transmitting torque from one machine part to the other, the screw-threaded member and the screw-threaded sleeve being axially movable towards and away from one another, means associated with one of said machine parts axially moving one of said coupling halves generally axially relatively to the other thereby enabling a drive for one of the two machine parts and a brake device for the other machine part to be used in conjunction for engaging and releasing the coupling and wherein one of the screw-threaded member and the screw-threaded sleeve is axially slidably but non-relatively rotatably received with clearance on its respective rotary machine part and is provided with slots which extend substantially axially, whereby tightening of the taper thread eliminates said clearance.

3. An engageable and releasable rotary coupling for the non-relatively rotatable interconnection of two rotary machine parts the coupling comprising two coupling halves, one said coupling half including a screw-threaded member having an external taper thread, the other of said coupling half including a sleeve having a complementary internal taper thread screwably receiving the external taper thread of said one half to act as a coupling means for transmitting torque from one machine part to the other, the screw-threaded member and the screw-threaded sleeve being axially movable towards and away from one another, means associated with one of said machine parts axially moving one of said coupling halves generally axially relatively to the other thereby enabling a drive for one of the two machine parts and a brake device for the other machine part to be used in conjunction for engaging and releasing the coupling, a brake device associated with one of said rotary machine parts adapted to release the respective rotary machine part when a predetermined initial torque of the coupling is reached and in which the brake device has a stop which it offers to a stop surface of respective rotary machine part upon coupling engagement and which yields at a predetermined torque.

4. An engageable and releasable rotary coupling for the non-relatively rotatable interconnection of two rotary machine parts the coupling comprising two coupling halves, one said coupling half including a screw-threaded member having an external taper thread, the other of said coupling half including a sleeve having a complementary internal taper thread screwably receiving the external taper thread of said one half to act as a coupling means for transmitting torque from one machine part to the other, the screw-threaded member and the screw-threaded sleeve being axially movable towards and away from one another, means associated with one of said machine parts axially moving one of said coupling halves generally axially relatively to the other thereby enabling a drive for one of the two machine parts and a brake device for the other machine part to be used in conjunction for engaging and releasing the coupling, and in which one coupling half is flexibly coupled to its respective rotary machine part and a support is provided on the latter to restrict the freedom of motion of that one coupling half to enable the coupling halves to be guided one into the other.

5. A rotary coupling as claimed in claim 4 in which the support comprises a shaft extension which internally supports the respective coupling half.

6. A rotary coupling as claimed in claim 4 in which the support comprises a sleeve-like holder which externally supports the respective coupling half.

7. A rotary coupling as claimed in claim 1 in which the axial movement of the coupling is effected by means displacing at least one of the rotary machine parts axially relatively to the other.

8. A rotary coupling as claimed in claim 2 in which the axial movement of the coupling is effected by means displacing at least one of the rotary machine parts axially relatively to the other.

9. A rotary coupling as claimed in claim 1 in which one of the screw-threaded member and the screw-threaded sleeve is axially slidably but non-relatively rotatably received with clearance on its respective rotary machine part and is provided with slots which extend substantially axially, whereby tightening of the taper thread eliminates said clearance.

10. A rotary coupling as claimed in claim 3 in which the axial movement of the coupling is effected by means displacing at least one of the rotary machine parts axially relatively to the other.

11. A rotary coupling as claimed in claim 4 in which the axial movement of the coupling is effected by means displacing at least one of the rotary machine parts axially relatively to the other.

12. A rotary coupling as claimed in claim 4 or 11 having means by which the screw-threaded member and the screw-threaded sleeve can be pushed axially one into the other before the commencement of the rotary movement for the purpose of the coupling operation, one of said member and sleeve being connected to its rotary machine part so as to be non-rotatable relative thereto and being displaceable to a limited extent in an axial direction relative to its rotary machine part against the force of a spring, and the other abutting against an alignment stop on its connected rotary machine part, whereupon the displaceable screw-threaded member or the screw-threaded sleeve is screwably engaged with the respective countermember upon commencement of the rotary movement.

13. A rotary coupling as claimed in claim 12 in which one of the screw-threaded member and the screw-threaded sleeve is axially slidably but non-relatively rotatably received with clearance on its respective rotary machine part and is provided with slots which extend substantially axially, whereby tightening of the taper thread eliminates said clearance.

14. A rotary coupling as claimed in claim 12 in which one of the screw-threaded member and the screw-threaded sleeve is axially slidably but non-relatively rotatably received with clearance on its respective rotary machine part and is provided with slots which extend substantially axially, whereby tightening of the taper thread eliminates said clearance.

15. A rotary coupling as claimed in claim 13 having a brake device associated with one of said rotary machine parts adapted to release the respective rotary machine part when a predetermined initial torque of the coupling is reached.

16. A rotary coupling as claimed in claim 14 having a brake device associated with one of said rotary machine parts adapted to release the respective rotary machine part when a predetermined initial torque of the coupling is reached.

17. A rotary coupling as claimed in claim 1 or 7 in which one of the screw-threaded member and the screw-threaded sleeve is axially slidably but non-relatively rotatably received with clearance on its respective rotary machine part and is provided with slots which extend substantially axially, whereby tightening of the taper thread eliminates said clearance.

18. A rotary coupling as claimed in claim 2 or 8 or 9 having a brake device associated with one of said rotary machine parts adapted to release the respective rotary machine part when a predetermined initial torque of the coupling is reached.

19. A rotary coupling as claimed in claim 17 having a brake device associated with one of said rotary machine parts adapted to release the respective rotary machine part when a predetermined initial torque of the coupling is reached.

20. A rotary coupling as claimed in claim 3 or 10 in which the yielding stop comprises a piston or a piston rod of a cylinder which is subjected to the pressure of a pressure medium only up to the attaining of the predetermined torque of the brake rotary machine part.

21. A rotary coupling as claimed in any of claims 1 or 2 or 3, or 4 to 5, or 7 to 16 in which the brake device has a fixed stop which it offers to a stop surface of the respective rotary machine part upon coupling disengagement.

22. A rotary coupling as claimed in claim 3 in combination with other like rotary coupling plurality of shafts arranged adjacent to one another to shafts which are arranged opposite thereto in a corresponding manner, in which the stops of all the brake devices are arranged on an axially displaceable beam so that either stops for engagement or stops for disengagement of the couplings can be brought into operative position.

* * * * *

UNITED STATES PATENT AND TRADEMARK OFFICE

CERTIFICATE OF CORRECTION

PATENT NO. : 4,391,357

DATED : July 5, 1983

INVENTOR(S) : ALI BINDERNAGEL, HELMUT HOLTHOFF and HARTMUT DIEL

It is certified that error appears in the above-identified patent and that said Letters Patent is hereby corrected as shown below:

Column 2, line 24, --device-- should be inserted after "brake".

Column 5, line 13, "IV-13IV" should read --IV-IV--.

Column 5, line 49, "flang" should be --flange--.

Signed and Sealed this

*Eighth* Day of *November 1983*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,391,357

DATED : July 5, 1983

INVENTOR(S) : Ali Bindernagel, Helmut Holthoff and Hartmut Diel

It is certified that error appears in the above-identified patent and that said Letters Patent is hereby corrected as shown below:

On the Title Page, the Assignee should be --Kocks Technik GmbH & Co.--.

Signed and Sealed this

*Thirty-first* Day of *July 1984*

[SEAL]

*Attest:*

GERALD J. MOSSINGHOFF

*Attesting Officer*

*Commissioner of Patents and Trademarks*